US005489187A

United States Patent [19]

Ray

[11] Patent Number: 5,489,187

[45] Date of Patent: Feb. 6, 1996

[54] IMPELLER PUMP WITH VANED BACKPLATE FOR CLEARING DEBRIS

[75] Inventor: Robert B. Ray, Vancouver, Wash.

[73] Assignee: Roper Industries, Inc., Bogart, Ga.

[21] Appl. No.: 300,995

[22] Filed: Sep. 6, 1994

[51] Int. Cl.[6] ..... F04D 29/10

[52] U.S. Cl. ..... 415/111; 415/170.1

[58] Field of Search ..... 415/110, 111, 415/106, 198.1, 208.2, 170.1

[56] References Cited

U.S. PATENT DOCUMENTS

| | | | |
|---|---|---|---|
| 768,911 | 8/1904 | Schoene | 415/106 |
| 2,349,731 | 5/1944 | Hornschuch . | |
| 2,777,395 | 1/1957 | Disbrow | 415/112 |
| 3,076,412 | 2/1963 | Harker et al. | 415/170.1 |
| 4,527,947 | 7/1985 | Elliott . | |
| 4,664,592 | 5/1987 | Grzina . | |
| 4,795,167 | 1/1989 | Otsuka | 415/111 |
| 4,812,108 | 3/1989 | Kotera | 415/111 |
| 4,854,820 | 8/1989 | Zolotar et al. . | |
| 5,076,757 | 12/1991 | Dorsch . | |
| 5,195,867 | 3/1993 | Stirling | 415/111 |
| 5,336,048 | 8/1994 | Ganzon et al. | 415/175 |

FOREIGN PATENT DOCUMENTS

| | | | |
|---|---|---|---|
| 6101 | 1/1977 | Japan | 415/106 |

*Primary Examiner*—Edward K. Look
*Assistant Examiner*—James A. Larson
*Attorney, Agent, or Firm*—Kolisch, Hartwell, Dickinson, McCormack & Heuser

[57] ABSTRACT

A centrifugal pump including a pump casing with internal walls defining a pump chamber and a seal cavity or chamber to the rear of the pump chamber. A rotatable impeller within the pump chamber is rotated by an impeller shaft extending through the seal cavity. Seal structure exposed to the seal cavity seals the impeller shaft to the casing. Vane structures joined to the wall defining the seal cavity produce a movement in the pumpage circulated in the seal cavity effective to remove debris and air bubbles that otherwise collect in the seal cavity.

9 Claims, 3 Drawing Sheets

IMPELLER PUMP WITH VANED BACKPLATE FOR CLEARING DEBRIS

BACKGROUND AND SUMMARY OF THE INVENTION

This invention relates to centrifugal pumps, and more particularly to centrifugal pumps featuring a construction promoting the removal of debris from a region of a seal chamber which encompasses a shaft driving the impeller of the pump.

In a conventional centrifugal pump, a pump casing includes internal wall structure defining a pump chamber which houses the rotatable impeller of the pump, and to the rear of or in back of this pump chamber a seal chamber, within which a small part of the liquid being pumped (or pumpage) is circulated. A power-driven impeller shaft rotates the impeller during operation of the pump, and this shaft extends to the rear of the impeller and through the seal chamber and thence outwardly through a backplate in the casing. Seal structure encircling this impeller shaft provides a fluid-tight seal between the shaft and the backplate.

In one form of prior art centrifugal pump, a certain amount of the pumpage is circulated in the seal cavity or chamber by the centrifugal action produced by the rotating impeller. The circulated pumpage functions as a coolant for the seal structure sealing the impeller shaft. A problem that arises is that entrained material in the pumpage, such as sand, air bubbles and other debris, tends to accumulate in the seal cavity or chamber in a region directly adjacent the seal structure which seals the impeller shaft to the backplate of the pump casing. The amount of debris and entrained bubbles that so collects can be substantial, and such material interferes with the cooling action and contributes to increased wear in the seal structure. The accumulation of air and/or debris in the region of the seal structure is effected by the manner in which the pump is mounted, with the tendency for air, for instance, to accumulate in the seal structure to be even greater when the pump is in a vertical mode than when the pump is mounted with its impeller shaft disposed horizontally.

This invention concerns a construction for a centrifugal pump which produces a movement in the pumpage or pumped liquid in the seal cavity effective continuously to flush out debris and the like, i.e., entrained air, thus bringing about more efficient cooling and reduced wear in the seal structure.

Another object is to provide a construction producing flushing of debris from a chamber holding pumpage located behind an impeller, which features vane structure joined to the wall defining the chamber producing a flushing action with pumpage moved across the vane structure by the action of the impeller.

A specific object of the invention is to provide a vane construction which includes one or more elongate vane structures extending along the incline of a wall defining a seal chamber in the pump, with the liquid pumped by the impeller moving across the vane structure to produce the circulation pattern desired.

A further specific object of the invention is to provide a vane construction which includes multiple sets of vane segments distributed circumferentially about the wall defining a chamber receiving pumpage fluid.

Yet another object, in one form of the invention, is to provide an improved impeller pump, with a construction for producing flushing of debris from adjacent the seal structure which supports the impeller shaft of the pump, and which further includes a supply for oil or lubricant for lubricating the seal structure.

BRIEF DESCRIPTION OF THE DRAWINGS

These and other objects and advantages are attained by the invention, which is described hereinbelow in conjunction with the accompanying drawings, wherein.

DETAILED DESCRIPTION OF THE PREFERRED EMBODIMENTS

Figure 1:
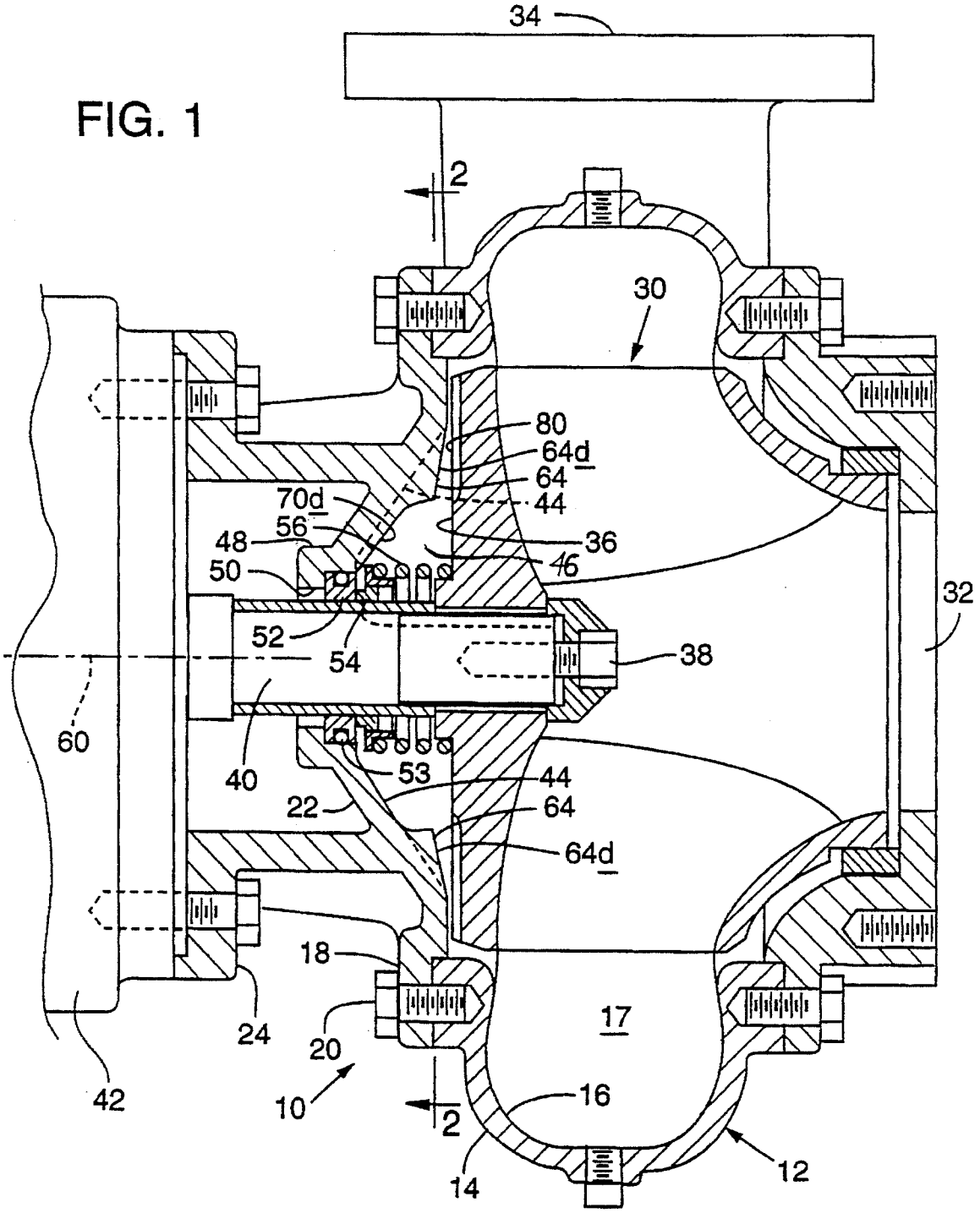
FIG. 1 is a cross-sectional view of a centrifugal pump featuring a construction for a seal chamber in the pump as contemplated by the invention.

Referring now to the drawings, and first of all more particularly to FIG. 1, a centrifugal pump is indicated generally at 10. The pump has a casing 12. Casing 12 includes a front casing section 14, with an internal pump chamber wall 16 defining a pump chamber 17 having the usual volute configuration. Also part of the casing is a back casing section 18. Fasteners 20 secure the two casing sections together. The back casing section includes a backplate portion 22 and a motor bracket portion 24.

A rotatable impeller 30 located within the pump chamber produces, on rotation, movement of the liquid pumped. This liquid enters the pump chamber through an inlet opening 32. Pumped liquid is ejected through a discharge 34. The impeller has a back 36.

The impeller is detachably mounted as by a fastener 38 on the forward end of a motor driven impeller shaft 40. This shaft extends outwardly from the back of the impeller to a suitable powered means, such as the electric motor shown partially at 42.

Backplate or backplate portion 22 has an inner wall 44, referred to as a seal chamber wall, which in general overall outline has a conically tapered or flaring shape. This wall and the back side of the impeller bound what is referred to as a seal chamber or cavity 46. The seal chamber has a smaller diameter end located directly forwardly of hub 48. By reason of the taper of the seal chamber wall, the seal chamber enlarges progressing from this end to the opposite or larger diameter end of the seal chamber, or from left to right in FIG. 1. This opposite end is located directly rearwardly of the back of the impeller.

Hub 48 extends about an opening 50 in the backplate which receives the impeller shaft. A seal structure exposed to the seal chamber seals the shaft and casing, and this seal structure comprises a stationery seal 52 and a rotary seal 54 which rotates with the impeller shaft. A compression spring 56 urges the rotary seal against the stationery seal. With the construction described, liquid within the seal chamber is prevented from leaking outwardly past the backplate of the casing.

During operation of the pump, part of the liquid being pumped flows into the seal chamber while moving between the back of the impeller and the backplate of the casing, which are not in fluid-tight engagement. This circulating fluid is relied upon to produce cooling of the seal structure just described.

As briefly discussed earlier, a problem which has arisen is that debris and entrained air bubbles carried by the pumpage, the debris including sand particles and other dirt particles such as sewage particles, tend to collect in the seal chamber, in the small diameter end of the chamber and in a region directly adjacent the seal structure. This interferes with the efficiency of the cooling action of the liquid, and also tends to produce premature wear in the parts producing the seal. The pump illustrated includes a construction which produces a type of fluid circulation in the seal chamber operating automatically to cause flushing of such debris from the seal chamber so as to eliminate the wear and overheating problems referred to.

Specifically, as contemplated herein, a vane construction comprising plural vane structures is provided, where the vane structures are joined with the rear wall of the seal chamber and are effective to produce a circulating action in pumpage moved across the vane structures which results in debris leaving the smaller diameter end of the seal chamber to move to the larger diameter end and thence out into the main discharge stream of the pump.

Figure 2:
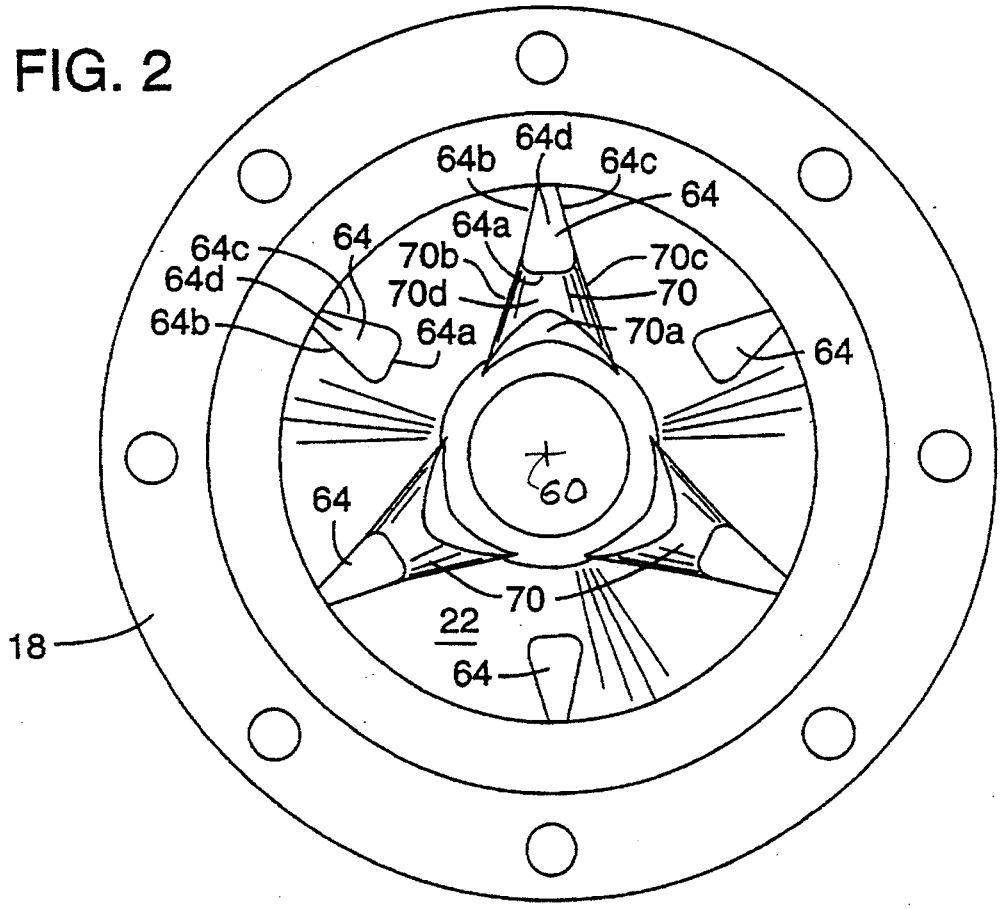
FIG. 2 is a view taken generally along the line 2—2 in FIG. 1, viewing the front of a backplate portion in the pump.
Figure 3:
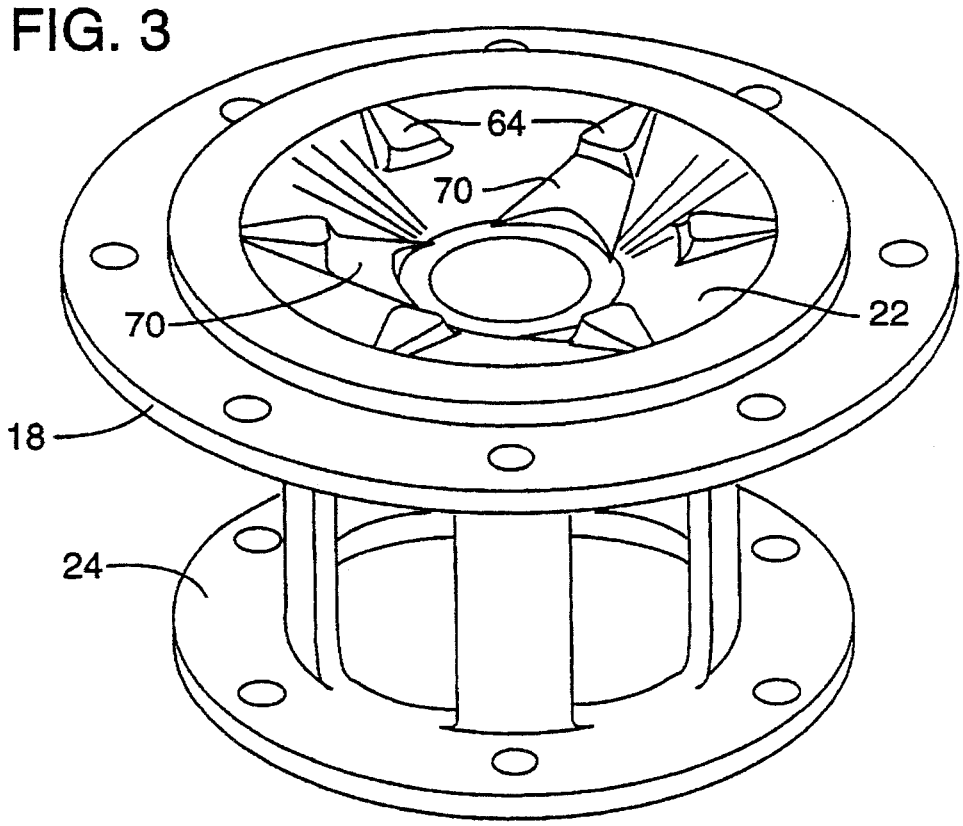
FIG. 3 is a perspective view of the backplate portion and showing other parts of casing structure in the pump.

Further explaining, and with further reference to FIGS. 2 and 3, equally circumferentially distributed about axis 60 of the impeller shaft are multiple (namely six in the embodiment of the invention illustrated) outer vane segments 64. In frontal outline, as illustrated in FIG. 2, each of these outer vane segments has a shape which roughly may be described as a truncated triangle, and includes a base 64*a* and opposite side 64*b* and *c*. Each vane projects outwardly from the seal chamber wall, with its front face 64*d* extending at only a slight angle relative to a plane perpendicular to the axis of the shaft compared to the slope of the inclined pump seal chamber wall, which extends at a greater angle with respect to this plane. By reason of this incline, each outer vane segment has an increasing height or greater projection from the inclined pump seal chamber wall progressing in a radially inward direction on the seal chamber. Explaining a typical construction, face 64*d* might extend at an angle of approximately 10° (with respect to a plane perpendicular to the axis of the shaft). In comparison, the tapered seal chamber wall might extend at an angle of approximately 35° with respect to this perpendicular plane. It should be understood that the specific values herein given are exemplary only, and are subject to variation depending upon pump construction.

Distributed circumferentially about the shaft axis are multiple (three in the embodiment shown) inner vane segments 70 which extend inwardly on the seal chamber wall from the inner ends of alternate ones of the outer vane segments. Each inner vane segment has an arcuate, concavely curving base 70*a*, and opposite sides 70*b* and 70*c*, with these sides forming extensions of side 64*b* and 64*c* of an outer vane segment. These sides diverge from each other progressing in a radially inward direction. The front face 70*d* of an inner vane segment inclines away from the tapered seal chamber wall progressing in a radially outward direction. As a result, these inner vane segments have increasing height progressing radially outwardly on the seal chamber. With the seal chamber wall inclining at an angle of 35° with respect to a plane extending perpendicular to the axis of the impeller shaft, the face of an inner vane segment might incline at a somewhat greater angle with respect to this plane, for example, an angle of 45°.

The sides of the outer and inner vane segments need not join with the faces of these respective vane segments at a sharp angle, but over a slight round, which tends to reduce excessive turbulence in the circulation of pumpage moving over the vanes.

Figure 4:
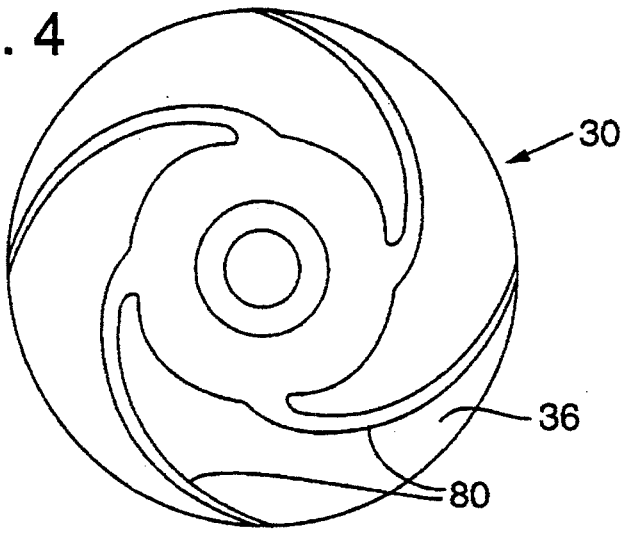
FIG. 4 is a view, on a somewhat reduced scale, illustrating the back side of an impeller in the pump.

In the particular pump illustrated, the back of the impeller is also provided with vanes. These are illustrated in FIGS. 1 and 4 by the arcuately curving vanes 80 shown. By the inclusion of these vanes, a greater swirling action of the pumpage liquid in the seal chamber is produced with rotation of the impeller than is produced when the back side of the impeller is smooth.

It will be noted that in the pump described, the inner vane segments 70 constitute a set of vane segments projecting outwardly from the seal chamber wall. The outer set of vane segments 64 constitute another set of vane segments joined to and projecting outwardly from the seal chamber wall.

Describing the operation of the pump, with a conventional pump, and with rotation of the impeller 30, a certain amount of the pumpage liquid works into the space provided behind the impeller, i.e., the seal cavity or seal chamber. This pumpage cools the seal structure provided for producing a fluid-tight seal around the impeller shaft.

Without the inclusion of the vane construction herein described, debris such as sand, dirt or entrained air bubbles tends to collect in a region directly adjacent the seal construction at the smaller diameter end of the seal chamber, with the disadvantages earlier discussed. This build-up is effectively prevented with the vane construction of the invention.

Figure 5:
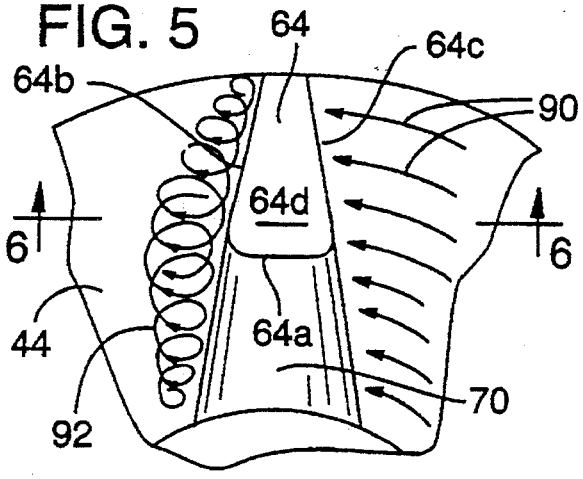
FIG. 5 is a schematic illustration showing how pumpage is caused to circulate over a vane structure in the pump.
Figure 6:
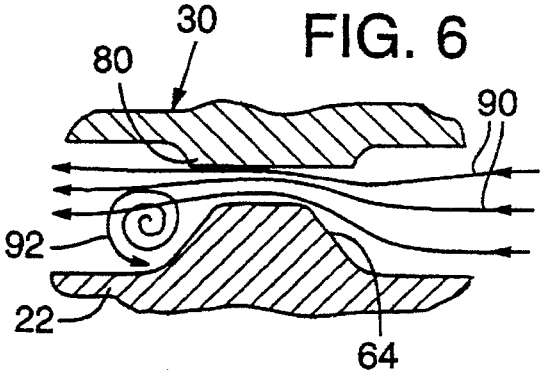
FIG. 6 is a cross-sectional view taken, generally along the line 6—6 in FIG. 5.

Referring to FIGS. 5 and 6 which illustrate schematically the operation of a vane structure in the pump, arrows 90 indicate generally the direction of flow of pumpage produced by rotation of the impeller. As this pumpage moves over a vane structure, a vortexing action results producing a swirling action illustrated by the helical arrows 92. The swirling action apparently increases progressing in a direction extending radially outwardly along an inner vane segment 70 to reach a maximum at a region where the inner extremity of an outer vane segment 64 is located. The vortexing action then decreases gradually moving radially outwardly along an outer vane segment. The swirling action produced by the inner vane segments functions initially to clear the debris from the region of the seal structure. The diverging sides of the inner vane segments produce a vortexing action traveling in part in a circumferential direction. The outer vane segments have the function of actually expelling this material from out of the seal cavity or chamber.

Each of the vane segments is symmetrical about a longitudinally extending plane bisecting the segment. Thus they function in the same manner regardless of the direction in which the impeller is rotated.

Figure 7:
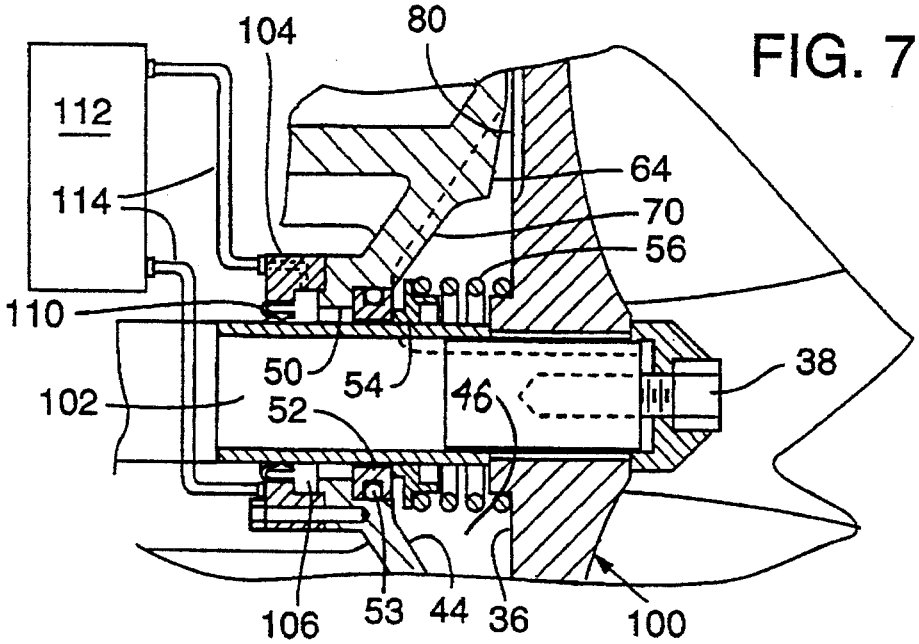
FIG. 7 is a cross-sectional view of portions of a centrifugal pump constructed pursuant to a modification of the invention.

In FIG. 7, there is illustrated a modification of this invention. Referring to this figure, an impeller is indicated at 100 mounted on an impeller shaft 102. A fluid-tight seal is produced between this impeller shaft and backplate 104 of the casing by a seal structure including seals 52, 54.

An oil gland 110 is provided for confining a volume of oil about the impeller shaft in region 106 to the rear of the seal structure. This oil or lubricant keeps the seal faces lubricated in the event that the pump is operated with no pumpage in the casing (a run-dry situation). An oil reservoir is indicated at 112. Oil supply lines 114 extend from the oil reservoir to the oil gland.

In FIG. 7, the seal chamber is again indicated at 46 and inner and outer vane segments at 64 and 70. The vane segments, as in the first described modification of the invention, are equally circumferentially distributed about the axis of the impeller shaft. The vane segments in this modification of the invention produce pumpage circulation effective to remove debris from the vicinity of the seal structure. They perform the additional function of slightly reducing the circulating velocity of pumpage within the seal chamber. In a situation where there is a large suction lift (negative pressure at the eye of the impeller), this reduced velocity results in a reduced negative pressure at the region of the seal structure. As a result, enough pressure is maintained by spring 56 to keep seal faces in the seal structure from becoming separated and dumping oil from the oil gland into the pumpage. A pump which includes the vane construction of the invention, therefore, may be employed in a variety of installations where the dumping of oil from the oil gland might otherwise have occurred.

While specific embodiment of the invention has been described, as well as certain modifications and other embodiments, it should be obvious that other variations and modifications are possible without departing from the invention.

It is claimed and desired to secure by Letters Patent:

1. A centrifugal pump comprising:

a casing, and pump chamber and seal chamber walls within the casing defining a pump chamber and a seal chamber, respectively, with the seal chamber to the rear of the pump chamber, a rotatable impeller disposed within the pump chamber and the impeller having a back face facing the seal chamber, a shaft for the impeller supporting the impeller and the shaft extending through the seal chamber, and seal structure for the shaft with the seal structure exposed to the seal chamber, multiple stationary vanes distributed circumferentially of the shaft joined to the seal chamber wall projecting outwardly of and interrupting the general outline of the seal chamber wall, and said vanes producing fluid movement in said seal chamber effective to cause movement of material away from the region of said seal structure, said seal chamber having a smaller diameter end remote from the pump chamber and a larger diameter end adjacent the pump chamber, and the vanes extending from adjacent said smaller diameter end and toward said larger diameter end and having increasing projection from the seal chamber wall progressing in a direction toward said larger diameter end.

2. The centrifugal pump of claim 1, wherein the vanes are equally circumferentially distributed about the axis of said shaft.

3. The centrifugal pump of claim 1, wherein the vanes are equally circumferentially distributed about the axis of said shaft, and each vane is bisectable by a plane which passes through the axis of the shaft, and is symmetrical with respect to said plane.

4. A centrifugal pump including a casing and the casing including pump and seal chamber walls spaced axially from each other and defining a pump chamber and a seal chamber, respectively:

an impeller mounted within the pump chamber, said impeller having a back side facing the seal chamber and forming the forward limit of the seal chamber, a shaft supporting the impeller extending through the seal chamber, and seal structure for said shaft with the seal structure exposed to the seal chamber, the seal chamber having a smaller diameter end adjacent said seal structure and an opposite larger diameter end adjacent the back side of said impeller and the seal chamber wall flaring outwardly progressing from said diameter end to said larger diameter end, and at least one elongate vane structure joined with said seal chamber wall extending in the direction of flare of said seal chamber wall, said vane structure impeding the movement of fluid thereacross to produce a fluid circulation effective to clear material from adjacent said seal structure, the vane structure having one portion projecting outwardly from the seal chamber wall and another portion along the length of the vane structure projecting outwardly from the seal chamber wall to a greater extent than the projection of said one portion.

5. The pump of claim 4, wherein said another portion is spaced toward said larger diameter end of the seal chamber from said one portion.

6. The pump of claim 4, wherein the vane structure is duplicated by another vane structure joined to said seal chamber wall and spaced circumferentially about said shaft from the first-mentioned vane structure.

7. A centrifugal pump comprising:

a casing, and pump chamber and seal chamber walls within the casing defining a pump chamber and a seal chamber, respectively, with the seal chamber to the rear of the pump chamber, a rotatable impeller disposed within the pump chamber and the impeller having a back face facing the seal chamber, a shaft for the impeller supporting the impeller and the shaft extending through the seal chamber, and seal structure for the shaft with the seal structure exposed to the seal chamber, multiple stationary vanes distributed circumferentially of the shaft joined to the seal chamber wall projecting outwardly of and interrupting the general outline of the seal chamber wall, said seal chamber having a smaller diameter end and an opposite larger diameter end and said stationary vanes including a first set of vanes extending along the seal chamber wall adjacent said smaller diameter end and a second set of vanes extending along the seal chamber wall adjacent said larger diameter end of the seal chamber, said vanes producing fluid movement in said chamber effective to cause movement of material away from the region of said seal structure.

8. A centrifugal pump including a casing and the casing including pump and seal chamber walls spaced axially from each other and defining a pump chamber and a seal chamber, respectively:

an impeller mounted within the pump chamber, said impeller having a back side facing the seal chamber and forming the forward limit of the seal chamber, a shaft supporting the impeller extending through the seal chamber, and seal structure for said shaft with the seal structure exposed to the seal chamber, said seal chamber having a smaller diameter end adjacent said seal structure and an opposite larger diameter end adjacent the back side of said impeller and the seal chamber wall flaring outwardly progressing from said smaller diameter end to said larger diameter end, and at least one elongate vane structure joined with said seal chamber wall extending in the direction of flare of said seal chamber wall, said vane structure impeding the movement of fluid thereacross to produce a fluid circulation effective to clear material from adjacent said seal structure, said vane structure having a base disposed adjacent said seal structure, said base facing the seal structure and arcuately curving about the axis of said shaft.

9. A centrifugal pump comprising:

a casing, and pump chamber and seal chamber walls within the casing defining a pump chamber and a seal chamber, respectively, with the seal chamber to the rear of the pump chamber, a rotatable impeller disposed within the pump chamber and the impeller having a back face facing the seal chamber, a shaft for the impeller supporting the impeller and the shaft extending through the seal chamber, and seal structure for the shaft with the seal structure exposed to the seal chamber, multiple stationary vanes distributed circumferentially of the shaft joined to the seal chamber wall projecting outwardly of and interrupting the general outline of the seal chamber wall, and said vanes producing fluid movement in said seal chamber effective to cause movement of material away from the region of said seal structure, said seal chamber having one end remote from the pump chamber and an opposite end adjacent the pump chamber, and the vanes extending from adjacent said one end toward said opposite end and having increasing projection from the seal chamber wall progressing in a direction toward said one end.

* * * * *